United States Patent [19]

Theurer

[11] 4,094,251

[45] June 13, 1978

[54] MOBILE TRACK TAMPING MACHINE

[75] Inventor: Josef Theurer, Vienna, Austria

[73] Assignee: Frank Plasser Bahnbaummaschinen-Industriegesellschaft m.b.H., Vienna, Austria

[21] Appl. No.: 669,208

[22] Filed: Mar. 22, 1976

[30] Foreign Application Priority Data

Jun. 20, 1975 Austria ..... 4774/75

[51] Int. Cl.[2] ..... E01B 27/17

[52] U.S. Cl. ..... 104/12; 104/7 R

[58] Field of Search ..... 104/7 R, 10, 12, 14

[56] References Cited

U.S. PATENT DOCUMENTS

| | | | |
|---|---|---|---|
| 1,556,604 | 10/1925 | Jackson | 104/12 |
| 3,465,688 | 9/1969 | Sauterel | 104/12 |
| 3,589,297 | 6/1971 | Plasser et al. | 104/12 |
| 3,595,170 | 7/1971 | Plasser et al. | 104/12 |
| 3,719,150 | 3/1973 | Theurer et al. | 104/12 |
| 3,795,198 | 3/1974 | Plasser et al. | 104/12 |
| 3,799,059 | 3/1974 | Sieke et al. | 104/12 |

FOREIGN PATENT DOCUMENTS

| | | | |
|---|---|---|---|
| 2,426,841 | 1/1975 | Germany | 104/12 |
| 2,460,700 | 7/1975 | Germany | 104/12 |

*Primary Examiner*—Randolph A. Reese
*Attorney, Agent, or Firm*—Kurt Kelman

[57] ABSTRACT

A mobile track tamper comprises a tamping tool assembly mounted on a machine frame for vertical movement. Each tamping tool assembly includes two pairs of vibratory tamping tools spaced from each other in the direction of track elongation so that each pair of tools may be immersed in successive cribs and the two units are so spaced that all four pairs are immersible in successive cribs. The tools of each pair are reciprocable in opposite directions towards and away from the elongated edges of adjacent ties wherebetween the cribs are defined. A common drive vertically moves the tamping tools on a carrier.

14 Claims, 10 Drawing Figures

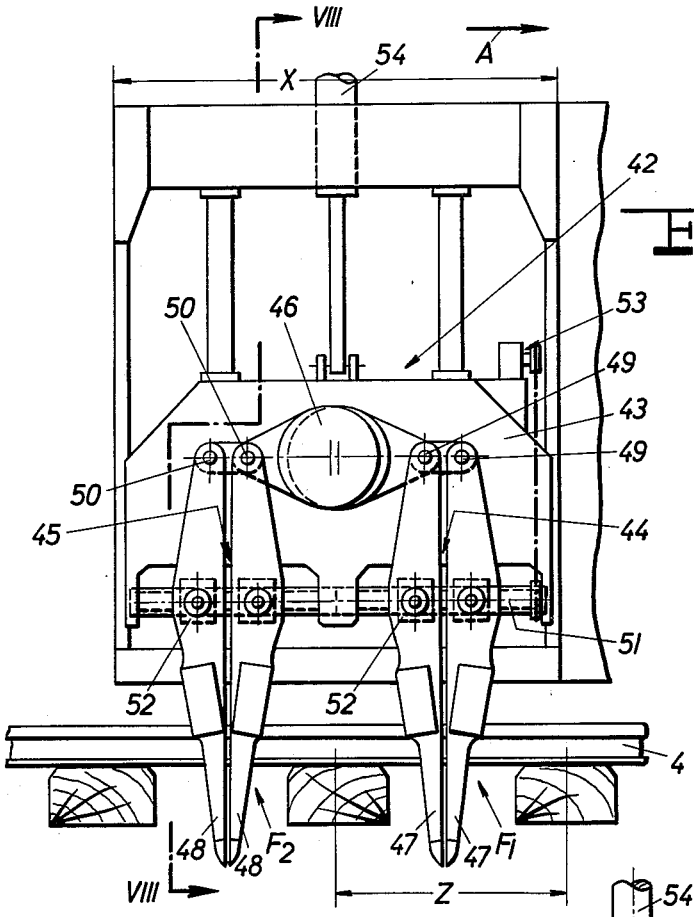
FIG. 7
FIG. 9
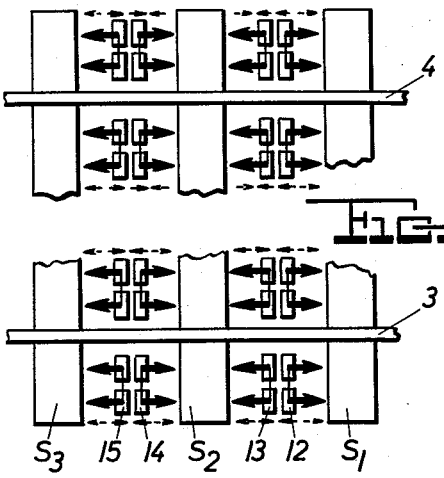
FIG. 8
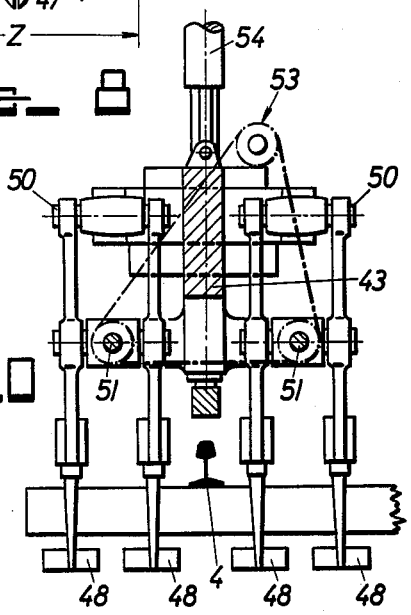
FIG. 10

MOBILE TRACK TAMPING MACHINE

The present invention relates to a mobile track tamping machine for substantially simultaneously tamping ballast underneath successive track ties resting on the ballast. Such ties have elongated edges extending transversely of the track and two ends extending in the direction of the track, the elongated edges of adjacent ones of the ties defining cribs therebetween.

U.S. Pat. No. 3,357,366, dated Dec. 12, 1967, and No. 3,372,651, dated Mar. 12, 1968, disclose highly successful, high-quality tampers with a tamping assembly designed for the simultaneous tamping of two ties. The tamping assembly comprises two pairs of tamping tools which effectuate a pincer movement for tamping ballast under each tie, the tamped ties being positioned between the tools of each pair. Attempts to use more than one such tamping assembly in an effort to tamp more than two adjacent ties simultaneously have encountered difficulties because the operator has found it hard to center the tamping tools properly for immersion in the ballast and thus to avoid damage to the ties. Further problems have included the structural arrangement of the tamping tools in combination with track correction units and their associated reference systems, as well as additional ballast tampers that are often found desirable.

Compared to pairs of tamping tools compacting ballast underneath a tie between the tools by a pincer movement of the tools, spreading tamping tools, such as disclosed in German Pat. No. 1,910,652, have the advantage of structural simplicity in arranging the tools and their drives.

In German Offenlegungsschrift (Published Application) No. 2,426,841, published Jan. 2, 1975, there is disclosed a mobile track tamping machine with two independently vertically movable tamping tool assemblies. Each tamping tool assembly includes a pair of vibratory tamping tools spaced from each other in the direction of the track so that each pair of tools is in vertical alignment with a respective one of successive cribs, and a single tamping tool spaced from the pair of tools so that it is in vertical alignment with an adjacent crib whereby the tamping tools may be immersed in four cribs upon simultaneous vertical downward movement of the tamping tool assemblies. This arrangement requires a pair of tools to be immersed at each intermittently proceeding tamping step in a crib in which a single tool was immersed in the preceding step and, additionally, provides an uneven and irregular ballast compaction over a long stretch of track because of the difference in the number of tamping tools immersed in adjacent cribs. Even more disadvantageous is the fact that the operator has difficulty in clearly observing the immersion of the tools in four cribs so that the descending tamping tools will cause damage to any tie in the path of the vertically downward moving tool. The operation is relatively slow and the construction is complex, particularly in combination with the drives for vertical moving, reciprocating and vibrating the tamping tools, and is correspondingly subject to frequent break-downs.

In my copending application Ser. No. 669,207 filed concurrently and entitled "Mobile Track Tamping Machine," I have disclosed simultaneous tamping of four ties. Pertinent portions of this application are incorporated herein by way of reference.

It is the primary object of this invention to provide a mobile track tamping machine for substantially simultaneously tamping ballast underneath a plurality of immediately adjacent ties in a single step while avoiding the disadvantages inherent in conventional machines and more uniformly distributing ballast from all worked cribs underneath the adjacent ties so as to improve the tamping quality and to obtain enhanced operating efficiency.

The invention is based on the recognition that the quality of track surfacing has been enhanced by 50% by working on two ties simultaneously, as disclosed in the two above-mentioned U.S. patents, because the intermediate pair of tamping tools spreads the ballast underneath the adjacent ties and the ballast compaction is not disturbed in a subsequent step since no tamping tools are again immersed into this crib in a subsequent tamping step, as is the case in the intermittently proceeding tie tamping wherein ties are tamped one by one.

The above and other objects are accomplished in accordance with the present invention with a mobile track tamping machine which comprises a machine frame and a tamping tool assembly mounted on the machine frame and including a carrier for the tamping tools mounted for vertical movement on the frame, and two pairs of vibratory tamping tools spaced from each other in the direction of the track. The spacing is such that each pair of tools is in vertical alignment with a respective one of two successive cribs whereby the tamping tools of each pair may be immersed in the respective crib upon vertical downward movement of the carrier. The tamping tools of each pair are reciprocable in opposite directions towards and away from a respective one of the elongated edges of an adjacent tie. The assembly further comprises a drive for vibrating the tamping tools, a drive for reciprocating the tamping tools and a drive for vertically moving the tamping tool carrier.

In my concurrently filed application of the same title, I disclose and claim two such tamping tool assemblies mounted on a mobile track tamping machine and so spaced from each other in the direction of track elongation that the tamping tools may be immersed in four successive cribs upon the vertical downward movement of the assemblies.

With a machine of such structure, pairs of tamping tools are immersed in successive cribs only once so that no subsequent immersion of tools in previously worked cribs can disturb the ballast compaction. The pairs of tools immersed in each crib displace a relatively large volume of ballast so that the ballast compaction is increased because it is produced not only by the conventional vibration and reciprocation of the tamping tools but also by the increased ballast displacement. This enhances the solidity and uniformity of the ballast bed compaction over a long stretch of track and has the advantage of requiring centering of the tamping tool pairs in only two successive cribs while offering great advantages in construction.

The above and other objects, advantages and features of this invention will become more apparent from the following detailed description of certain now preferred embodiments thereof, taken in conjunction with the accompanying drawing wherein FIG. 1 is a side elevational view of a mobile track tamping machine according to one embodiment of the invention;

FIG. 7 is a side elevational view of another embodiment of a tamping tool assembly;

FIG. 8 is an end view of the assembly of FIG. 7, taken along line VIII—VIII;

FIG. 9 is a schematic top view showing the positions of the tamping tool jaws of the tamping tools of the assembly of FIG. 7; and FIG. 10 is a similar top view showing the positioning of the tamping tools of the assembly of FIGS. 1 to 3.

Figures 1, 2, 3, 4, 5:
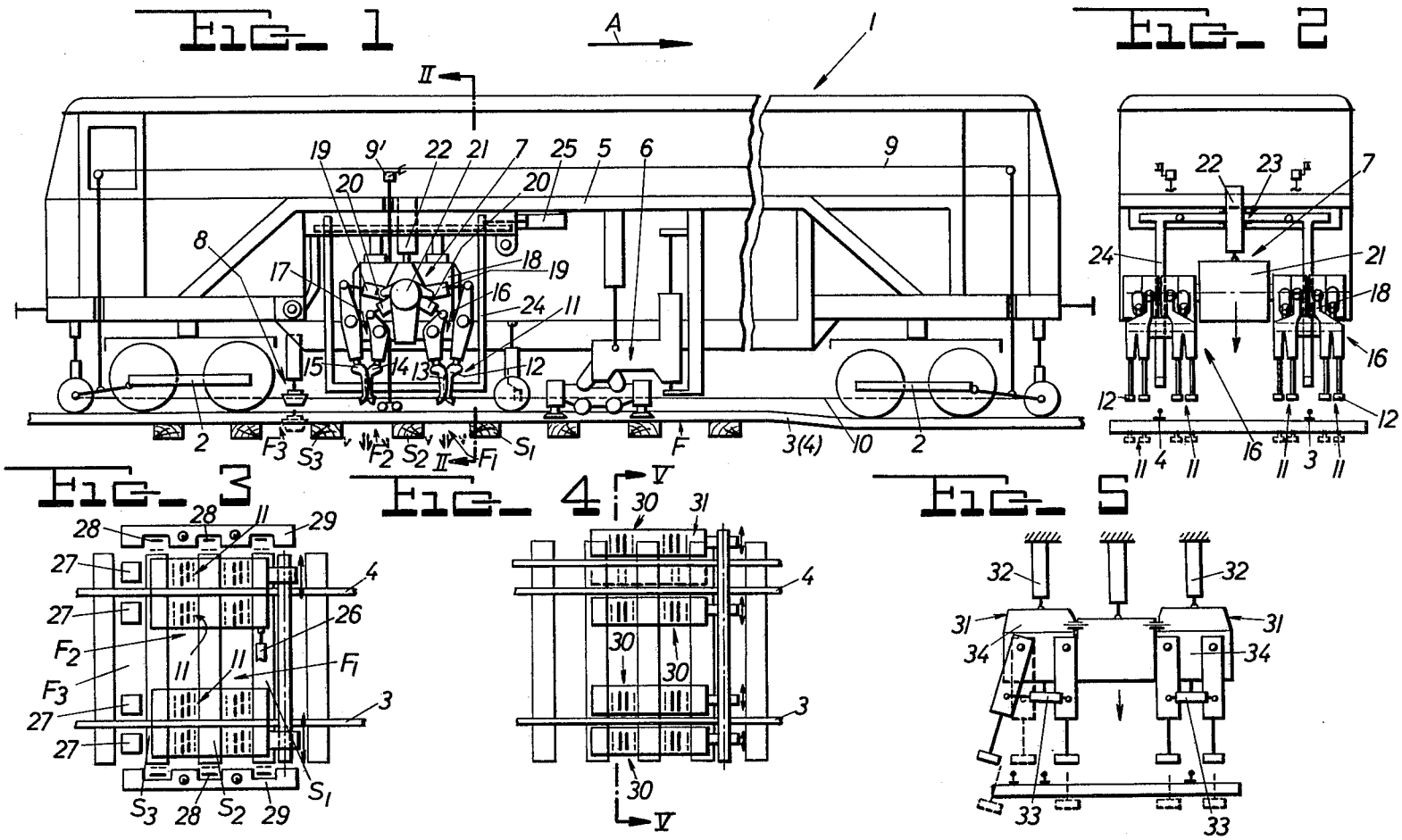
FIG. 2 is an end view of the tamping tool assembly, taken along line II—II of FIG. 1.
FIG. 3 is a schematic top view of the tamping tool assembly of FIG. 1 and the track section on which it works.
FIG. 4 is a like top view of a modified tamping tool assembly particularly useful for work at track switches.
FIG. 5 is an end view of the tamping tool assembly of FIG. 4, taken along line V—V.

Referring now to the drawing and first to FIG. 1, there is shown a combined mobile track tamping, leveling and lining machine 1 comprising machine frame 5 mounted for mobility on track rails 3, 4 on undercarriages 2,2 for intermittent advancement in the direction of operation indicated by horizontal arrow A. Combined track lifting and lining unit 6 of generally conventional structure is mounted on frame 5 between the undercarriages.

Tamping tool assembly 7 constitutes a structural unit mounted on machine frame 5 for vertical movement. Carrier frame 24 for tamping tool assembly 7 is mounted on machine frame 5 for movement in the direction, as well as transversely of the track on guide beams affixed to frame 5 by means of hydraulic motors 25 and 26. This enables the proper centering of the tamping tools in the cribs $F_1$ and $F_2$ on track curves. The two pairs 16, 17 of tamping tools 12, 13 and 14, 15 of tamping tool assembly unit 7 are mounted on carrier 18 which is vertically movably mounted on vertical guide columns affixed to carrier 24. Hydraulic motor drive 22 for vertically moving the unit is also mounted on this carrier frame.

Identical units 7 are associated with rails 3 and 4, as shown in FIG. 2, a total of eight pairs of tamping tools being mounted on each unit. Each unit has an independent drive 22 for vertically moving the unit and also independently operable drives 19, 20 for reciprocating the tamping tools of each pair. The hydraulic motor drives 19, 20 link the upper ends of the tamping tools to eccenter shaft vibrating drive 21 which is centrally positioned between the tamping tool pairs 17 and 18, the tamping tools being pivotal about transverse axes intermediate the ends of the tools. This arrangement provides a particularly simple structure and permits the tamping tool assembly to be sufficiently short to fit the tamping tool pairs onto successive cribs. Reciprocation and vibration of the tamping tools are well controllable in this structure which makes it possible to practice asynchronous tamping with pairs of tamping tools.

The two pairs 17 of tamping tools 12, 13 and 14, 15 are spaced from each other in the direction of the track so that each pair of tools is in vertical alignment with a respective one of two successive ones of cribs $F_1$ and $F_2$ whereby the tamping tools of each pair may be immersed in the respective crib upon vertical downward movement of the unit. The tamping tools of each pair are reciprocable in opposite directions towards and away from a respective one of the elongated edges of an adjacent tie $S_1$, $S_2$ and $S_3$.

Four surface tampers 27 are mounted in a tamping unit 8 on machine frame 5 for compacting the ballast in crib $F_3$ behind a last one 15 of the tamping tools in the operating direction A of movement of the machine, thus assuring proper tamping of tie $S_3$ in cooperation with this last reciprocatory tamping tool.

The illustrated machine also includes a conventional track leveling and lining system, including leveling reference 19 and lining reference 10 which survey the track position and control the track lifting and lining unit 6. Such track surfacing being well known and forming no part of the present invention, it will not be described herein. As shown in FIG. 1, unit 6 is mounted on machine frame 5 frontward of tamping tool assembly unit 7, as viewed in the operating direction of movement of the machine, and track grade control signal emitter 9′ is arranged in the range of unit 7 to cooperate with reference line 9 for controlling the track lifting.

The top view of FIG. 3 clearly shows the position of the tamping tool pairs in relation to the ties and also shows the arrangement of surface tamper 29 adjacent the ends of the ties and extending over tamping tool assembly 7, the tamper body being vibrated and carrying individual tamping tools 28 adjacent each tie end and reciprocable towards and away from the tie ends. Such surface tampers are known and the illustrated arrangement could be replaced by individual vibratory and reciprocatory tamping tools mounted adjacent each tie end.

While the tamping tool assembly of FIGS. 1 to 3 has four pairs of tamping tools in transverse alignment associated with each track rail 3, 4, as best shown in FIG. 2, only two such transversely aligned tamping tool pairs are assocaited with each rail in the embodiment of FIGS. 4 and 5. The tamping tool assembly units 31 of this embodiment each have two pairs 34 of tamping tools in transverse alignment associated with each rail, two such double pairs being spaced from each other in the direction of the track on tamping tool carrier 34, as in the embodiment of FIGS. 1 to 3. Hydraulic drive 32 mounts units 31 for vertical movement or, if desired and as shown in FIG. 5, the two units may be coupled together for lifting in unison by a centrally arranged drive.

To enable the machine to be used for the tamping of switches, as shown in FIG. 5, the tamping tools are mounted for pivoting about an axis extending in the direction of the track in a transverse plane perpendicular to the track, a hydraulic pivoting drive 30 linking the tools to the tamping tool carrier. In this manner, a selected tamping tool or group of tools may be temporarily moved out of the way of a branch rail, as illustrated in FIG. 5.

Figure 6:
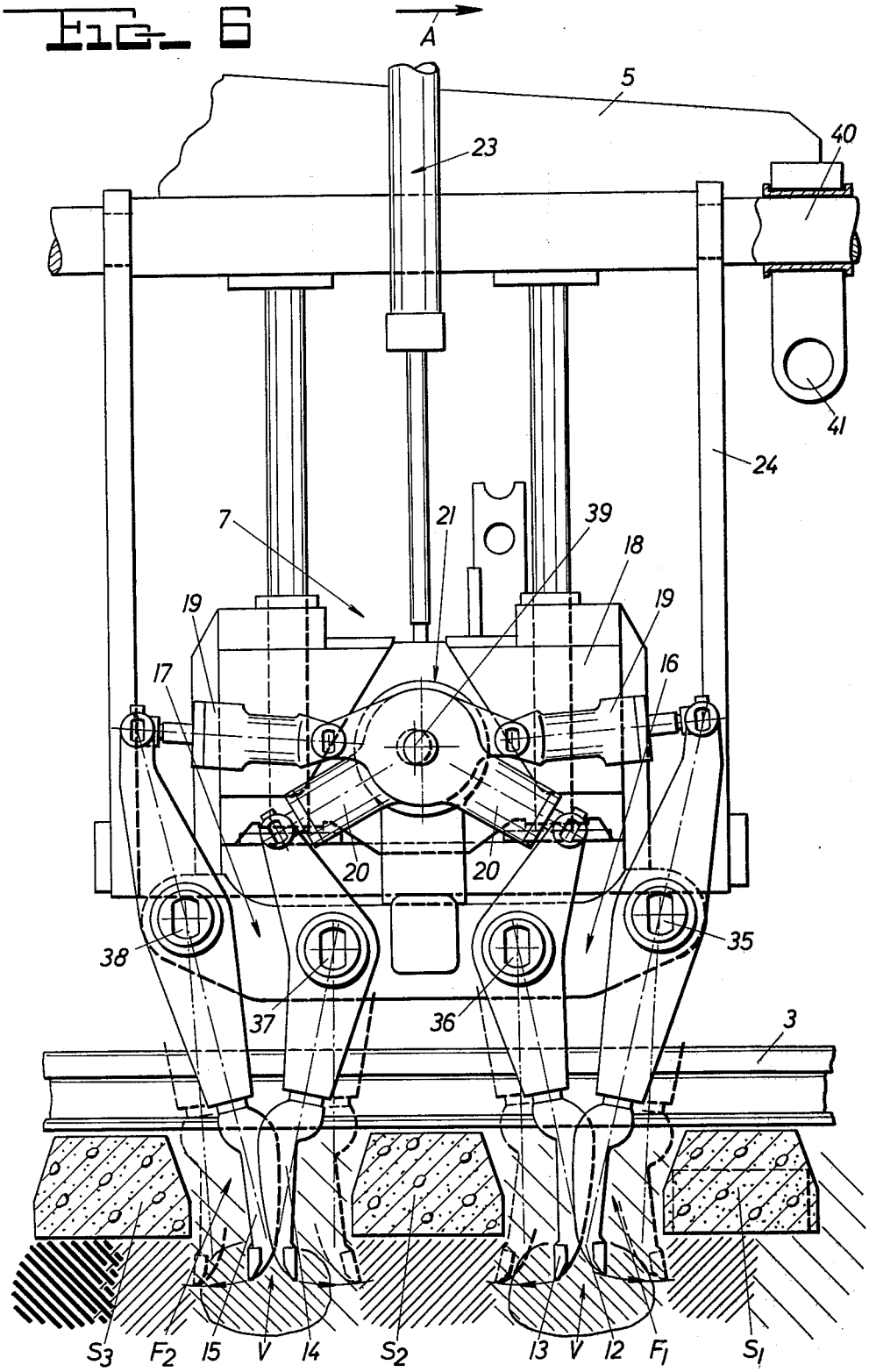
FIG. 6 is an enlarged side elevational view of the tamping tool assembly of FIG. 1.

FIG. 6 shows tamping tool assembly 7 of FIGS. 1 to 3 in more detail. Transversely extending pivoting axles 35, 36, 37, 38 mount tamping tools 12, 13, 14, 15 intermediate their ends on tamping tool carrier 18 to enable the tamping tools to be reciprocated in the direction of track elongation between the positions indicated in full and broken lines. Common vibrating drive 21 for the tamping tools comprises rotary eccenter shaft 39, and the upper ends of the tamping tools of each pair 16, 17 are linked to a pair of hydraulic motors 19, 20 for reciprocating the tools. The cylinders of the reciprocating drives are mounted on the vibrating drive while the piston rods thereof are linked to the tamping tool ends. The cylinder of hydraulic motor 23 is affixed to carrier frame 24 for tamping tool assembly 7 while the piston rod of the motor is connected to carrier 18 for vertically moving unit 7 along two vertical guide columns mounted in the carrier frame. The carrier frame is mounted on guide beam 40 extending in the direction of the track and enabling the carrier frame with unit 7 to be moved in this direction relative to machine frame 5. While hydraulic motor 25 has been shown for this purpose in FIG. 1, any suitable mechanical drive may be used. Furthermore, transversely extending guide beam 41 has been schematically indicated to show a guide means for transversely moving carrier frame 24 relative to the machine frame.

The operation of such a tamping tool assembly will be obvious from the above description of its structure and will be further elucidated hereinafter:

After the machine has been advanced to a position in which tamping tool pairs 16 and 17 are centered over cribs $F_1$ and $F_2$ for tamping ballast underneath ties $S_1$, $S_2$ and $S_3$, drive 23 is operated to lower the tamping tools into the ballast, as shown in FIG. 6. The tamping tools have offset upper portions, such as disclosed and claimed in U.S. Pat. No. 3,429,276, dated Feb. 25, 1969, which facilitate a proper reciprocating motion of the closely adjacent tampering tools. The immersed tamping tool jaws engage a relatively large volume V of ballast for movement under the adjacent track ties. The tamping efficiency will be increased if, as shown in FIG. 3, the transverse space between adjacent tamping tools is smaller than the average size of the ballast. In this manner, ballast pieces will wedge between these tools so as to prevent escape of ballast between the tools during reciprocation, thus providing even more effective tamping. During downward movement of the tamping tools into the cribs, they will downwardly displace ballast and form the compacted ballast zone V, providing additional ballast for displacement under the ties so as further to improve the support afforded to the ties after tamping.

During their immersion into the ballast and the reciprocation of the tamping tools, tools 12, 13 and 14, 15 of each pair 16 and 17 will be subjected to a vibratory motion in opposite directions. This combined downward, vibratory and reciprocatory movement of the tamping tools assures compaction of the ballast underneath adjacent ties $S_1$, $S_2$ and $S_3$, half of tie $S_3$ having been tamped by tamping tool 12 during the immediately preceding tamping step, as shown in heavy lines. This compacted ballast zone under the tie, in cooperation with the compacted ballast zone V produced by the downwardly moving tamping tools in the cribs, prevent the ballast being tamped under the adjacent ties from moving back into the crib, thus greatly increasing the tamping quality.

FIG. 10 shows, in heavy arrows, the reciprocatory movement of the tamping tools while the small arrows illustrate their vibratory movement, i.e., the counterphase vibration of tamping tools 12, 13 and 14, 15 of each pair 16 and 17, and the counterphase vibration of adjacent tools 13 and 14 of the pairs of tools. However, it will be understood that the tamping tools may also be so arranged that the tools of each pair vibrate in phase while the tools of one pair vibrate in counterphase to the tools of the other pair.

FIG. 6 shows the shape of concrete ties to indicate the usefulness of the tamping tool assembly for this type of ties, as well as for conventional wooden ties of rectangular cross section.

Operation of the tamping tool assembly is facilitated because the operator need to watch only two adjacent cribs and centering of the tamping tool pairs can be effected simply in relation to intermediate tie $S_2$. After tamping is completed, the tamping tools of each pair are reciprocated towards each other and the tamping tool assembly is then lifted to remove the tamping tools from the ballast without disturbing the tamped ballast zones. The hydraulic reciprocating drives make it possible, as is well known, to tamp the ballast by the asynchronous method since the tamping tools are reciprocated in response to the pressure encountered by the tamped ballast. Thus, completion of the tool reciprocation is not a function of a given stroke but of a predetermined degree of ballast compaction. The asynchronous reciprocation assures uniform ballast compaction even where the individual tamping tools move through different reciprocation strokes.

The embodiment of FIGS. 7 and 8 uses the reciprocation drive of previously mentioned Offenlegungsschrift No. 2,426,841. In this embodiment, tamping tool assembly 42 is mounted on carrier 43 supporting pairs 44 and 45 of tamping tools 47 and 48. The upper end of each tamping tool is linked to central eccenter shaft drive 46 for vibrating the tamping tools, the tools of each pair being connected to the same arm of the vibratory drive at pivoting axles 49, 50 extending transversely of the track. In this manner, the tools of each pair are vibrated synchronously but in the opposite direction as the tools of the other pair, as indicated by the arrows in FIG. 9, similar to the showing of FIG. 10. Such a vibratory movement is particularly useful in providing good and uniform ballast tamping.

The reciprocating drive serves for synchronous tamping and comprises threaded spindle 51 and a pair of nuts 52, 52 threadedly engaging the spindle which is rotatably journaled in carrier 43. Each nut is affixed to a respective tamping tool intermediate the ends thereof and the spindles are rotated by chain drive 53 or the like. As shown in FIG. 8, the spindles for reciprocation of all tamping tools may be driven by a single drive 53, synchronous movement of the tools being produced by the movement of the nuts along the spindles, the path of movement being identical for all tools.

Except for the asynchronous reciprocatory movement of the tamping tools, the embodiment of FIGS. 7 to 9 operates in the same manner as hereinabove described. The volume of ballast displaced in cribs $F_1$ and $F_2$ during the downward movement of the tools into the cribs is smaller than with the tools shown in FIG. 6 because the tamping tools have no offset upper portions but engage each other along a straight plane in the closed position and are not offset from each other in a direction transversely to the track. Thus, the pairs of tools cut into the ballast rather than pressing into it.

As in the previously described embodiments, tamping tool assembly unit 42 is vertically moved by hydraulic motor drive 54.

It will be useful to make elongation X of each tamping tool assembly unit equal to or smaller than the sum of two average spacings Z between adjacent ties.

It will be understood by those skilled in the art that the machine of the present invention is not limited to the illustrated and described specific embodiments and that the various drives may be operated not only hydraulically and mechanically but also electrically in any desired combination. Also, various means for vibrating the tamping tools and various types of such tools may be used without departing from the spirit and scope of this invention as defined by the claims.

I claim:

1. A mobile track tamping machine for substantially simultaneously tamping ballast underneath three successive track ties resting on the ballast, the ties having elongated edges extending transversely of the track and two ends extending in the direction of the track, the elongated edges of adjacent ones of the ties defining cribs therebetween, which comprises (1) a machine frame; and (2) a tamping tool assembly mounted on the machine frame and including (a) a carrier for the tamping tools mounted for vertical movement on the frame, (b) no more than four tamping tools immersible in the ballast and arranged on the carrier in two pairs of vibratory tamping tools spaced from each other in the direction of the track, the spacing being such that each pair of tools is in vertical alignment with a respective one of two successive ones of the cribs whereby the tamping tools of each pair may be immersed in the respective crib upon vertical downward movement of the carrier, (c) a pivot mounting each one of the tamping tools on the carrier for reciprocation of the tamping tools of each pair in opposite directions towards and away from a respective one of the elongated edges of an adjacent one of the ties, the pivots of each of the pairs of tamping tools being spaced from each other in the track direction less than one crib width, and the pairs of tamping tools having tamping jaws for immersion in the ballast whose closest spacing in the track direction is smaller than the average size of the ballast, (d) a common drive for vibrating the two pairs of tamping tools arranged on the carrier centrally with respect to the pairs of tamping tools, (e) a drive for independently reciprocating each of the tamping tools about their pivots, and (f) a drive arranged centrally with respect to the pairs of tamping tools for vertically moving the carrier with the tamping tools.

2. The mobile track tamping machine of claim 1, wherein the tamping tool assembly constitutes a structural unit and one of said units is mounted on the machine frame in association with each of the track rails.

3. The mobile track tamping machine of claim 2, wherein the length of the unit in the direction of the track is equal to, or smaller than, twice the average distance between the center lines of adjacent ties.

4. The mobile track tamping machine of claim 1, wherein the pivots extend transversely of the track and mount the upper ends of the tamping tools for pivoting on the carrier, and the tamping tools are connected intermediate their ends to the reciprocating drive.

5. The mobile track tamping machine of claim 4, wherein the reciprocating drive for each pair of tamping tools comprises a spindle and a pair of nuts threadedly engaging the spindle, a respective one of the nuts being affixed to a respective one of the tamping tools of each pair intermediate the ends thereof.

6. The mobile track tamping machine of claim 1, comprising tamper means arranged for compacting the ballast in the crib behind a last one of the tamping tools in the operating direction of movement of the machine.

7. The mobile track tamping machine of claim 1, further comprising means for moving the tamping tools in a direction transverse of the track.

8. The mobile track tamping machine of claim 7, wherein the means is arranged to move the individual tamping tools in said direction.

9. The mobile track tamping machine of claim 7, wherein the means is arranged to move the tamping tool assembly in said direction.

10. The mobile track tamping machine of claim 1, further comprising a pivoting axle for each tamping tool, the pivoting axles extending transversely of the track and mounting the tools intermediate their ends for pivoting on the carrier, and the reciprocating drive comprising a motor for each of the tamping tools, a respective one of the motors connecting an upper end of each of the tamping tools to the common vibrating drive.

11. The mobile track tamping machine of claim 10, wherein each reciprocating drive is a hydraulic motor.

12. The mobile track tamping machine of claim 1, wherein the common vibrating drive is arranged to vibrate the tamping tools of each pair in the same direction while vibrating the tamping tools of the adjacent pairs in opposite directions.

13. The mobile track tamping machine of claim 1, further comprising a tamping tool adjacent each of the ends of the tie intermediate the successive cribs.

14. The mobile track tamping machine of claim 13, further comprising a tamping tool adjacent each of the ends of the ties adjacent the successive cribs.

* * * * *

UNITED STATES PATENT AND TRADEMARK OFFICE

CERTIFICATE OF CORRECTION

PATENT NO. : 4,094,251

DATED : June 13, 1978

INVENTOR(S) : Josef Theurer

It is certified that error appears in the above-identified patent and that said Letters Patent are hereby corrected as shown below:

In the title page, at [73], line 1, change "Frank" to --Franz--; line 2, change "Bahnbaummaschinen" to --Bahnbaumaschinen--

Signed and Sealed this

*Twelfth* Day of *December 1978*

[SEAL]

*Attest:*

RUTH C. MASON
*Attesting Officer*

DONALD W. BANNER
*Commissioner of Patents and Trademarks*